US010897951B2

(12) United States Patent
Covel

(10) Patent No.: US 10,897,951 B2
(45) **Date of Patent: *Jan. 26, 2021**

(54) FOOTWEAR INSERT

(71) Applicant: Richard Covel, Venice, FL (US)

(72) Inventor: Richard Covel, Venice, FL (US)

( * ) Notice: Subject to any disclaimer, the term of this patent is extended or adjusted under 35 U.S.C. 154(b) by 29 days.

This patent is subject to a terminal disclaimer.

(21) Appl. No.: 16/332,415

(22) PCT Filed: Nov. 16, 2017

(86) PCT No.: PCT/US2017/061991

§ 371 (c)(1),
(2) Date: Mar. 12, 2019

(87) PCT Pub. No.: WO2018/094032

PCT Pub. Date: May 24, 2018

(65) Prior Publication Data

US 2020/0297066 A1 Sep. 24, 2020

Related U.S. Application Data

(63) Continuation-in-part of application No. 15/421,551, filed on Feb. 1, 2017, now Pat. No. 10,238,167.

(60) Provisional application No. 62/423,490, filed on Nov. 17, 2016.

(51) Int. Cl.

| | |
|---|---|
| ***A43B 5/00*** | (2006.01) |
| ***A43B 5/02*** | (2006.01) |
| ***A43B 7/32*** | (2006.01) |

(52) U.S. Cl.

CPC ..... *A43B 5/025* (2013.01); *A43B 7/32* (2013.01)

(58) Field of Classification Search

CPC .. A43B 5/025; A43B 7/32; A43B 5/02; A43B 23/028

USPC ..... 36/128, 133, 71, 72 R, 77 R, 112, 139

See application file for complete search history.

(56) References Cited

U.S. PATENT DOCUMENTS

| | | | |
|---|---|---|---|
| 2,389,032 | A | 11/1945 | Donnelly |
| 2,661,547 | A | 12/1953 | Hyde et al. |
| 3,561,142 | A | 2/1971 | Streit, Sr. et al. |
| 4,422,249 | A | 12/1983 | Hannah |
| 4,617,746 | A | 10/1986 | Hannah |

(Continued)

FOREIGN PATENT DOCUMENTS

| | | | |
|---|---|---|---|
| KR | 20-0437012 | Y1 | 10/2007 |
| WO | 2005107508 | A1 | 11/2005 |

OTHER PUBLICATIONS

PCT Notification Concemng Transmittal of International Preliminary Report on Patentability (Chapter I of the Patent Cooperation Treaty), dated May 31, 2019, nine (9) pages.

(Continued)

*Primary Examiner* — Marie D Bays
(74) *Attorney, Agent, or Firm* — Iandiorio Teska & Coleman, LLP

(57) ABSTRACT

A flexible insert or tongue for a sports shoe for kicking a ball which self activates upon the strike of a ball to deform in a manner that conforms to the struck curvature surface of the ball to assist in conforming the shoe surface material or the shoe tongue material to the same struck area of the ball and increase the wearers' control and accuracy of the kicked ball. Following the strike the flexible insert or tongue reforms to its original shape and structure for the next strike.

15 Claims, 9 Drawing Sheets

(56) References Cited

U.S. PATENT DOCUMENTS

| | | | | |
|---|---|---|---|---|
| 4,711,043 | A | 12/1987 | Johnson et al. | |
| 5,433,437 | A | 7/1995 | Dudley | |
| 5,897,446 | A | 4/1999 | Wiseman et al. | |
| 6,257,998 | B1 | 7/2001 | Ein-Gal | |
| D456,596 | S | 5/2002 | Hannah | |
| 6,421,936 | B1 | 7/2002 | Gerrand | |
| 6,637,132 | B2 | 10/2003 | Gerrand | |
| 7,562,471 | B2 | 7/2009 | Minami | |
| 8,356,429 | B2 | 1/2013 | Eder et al. | |
| 8,844,171 | B2 | 9/2014 | Eder et al. | |
| 10,238,167 | B2 * | 3/2019 | Covel | A43B 7/32 |
| 2007/0245596 | A1 | 10/2007 | Gerrand et al. | |
| 2008/0163519 | A1 | 7/2008 | Sartor et al. | |
| 2012/0233888 | A1 | 9/2012 | Baker et al. | |
| 2016/0331072 | A1 | 11/2016 | Gould et al. | |
| 2018/0125150 | A1 | 5/2018 | Fraser | |

OTHER PUBLICATIONS

Noguchi et al., Relationship between Ball Kick Velocity and Leg Strength: A Comparison between Soccer Players and Other Athletes, Advances in Physical Education 2012, vol. 2, No. 3, 95-98, Published online Aug. 2012 in SciRes (http://dx.doi.org/10.4236/ape.2012.23017).

The Sports Injury Doctor, Biomechanics of Soccer: The soccer-style kick—a slow motion commentary on one of the most common sporting actions in the world, (http://www.sportsinjurybulletin.com/archive/biomechanics-soccer.htm#), Green Star Media Ltd., (Aug. 2007) (four (4) pages).

* cited by examiner

FOOTWEAR INSERT

RELATED APPLICATIONS

This application is a continuation-in-part of U.S. patent application Ser. No. 15/421,551 filed on Feb. 1, 2017 and claims the benefit of and priority thereto under 35 U.S.C. §§ 119, 120, 363, 365, and 37 C.F.R. § 1.55 and § 1.78, and that application and this application also claim the benefit of and priority to U.S. Provisional Application Ser. No. 62/423,490 filed Nov. 17, 2016, and each of U.S. patent application Ser. No. 15/421,551 and U.S. Provisional Application Ser. No. 62/423,490 is incorporated herein by this reference.

FIELD OF THE INVENTION

The present invention relates generally to athletic footwear. More particular, this invention relates to an insert, inserted or installed in or on athletic footwear used in football, soccer or other sports, which require kicking any type of ball with the player's feet.

BACKGROUND OF THE INVENTION

The present invention relates to footwear, and more particularly to a flexible and shaped article inserted or installed in or on a specific area, such as the instep area, of the foot and footwear which indirectly or directly contacts the surface of a ball to optimize the gripping, control, and comfort of kicking a ball. There are many sports activities that include kicking a ball. Examples of such sports include soccer, football, rugby, Australian-rules football, and kickball. Conventional sports shoes that are available for these sports typically have an upper not very different from the uppers of other athletic shoes.

Features to optimize contact between the ball and shoe or foot have been previously proposed. Hyde (U.S. Pat. No. 2,661,547) teaches a passive concave attachment to a shoe providing a pocket on the top of the foot to receive a football when it is kicked. Hannah (U.S. Pat. Nos. 4,422,249 and 4,617,746) and Gerrand (U.S. Pat. Nos. 6,421,936 and 6,637,132, and WO 2005/107508 A1) teach shoes having passive surfaces to optimize kicking of a ball. Nike, Inc. (U.S. Pat. Nos. 7,562,471 and 8,356,429 and 8,844,171) also teach shoes having passive surfaces to optimize the control of a ball. All said references are incorporated herein by this reference.

Each of the aforementioned related art inventions have various drawbacks and do not address the optimizations inherent in the current invention. Added surfaces to the footwear lose their tack and effectiveness with age, UV exposure, wear, and from contact with dirt and field debris. Fixed shaped pockets and accessories placed on top of the footwear do not necessarily address all angles of a strike and can lessen accuracy from strikes off the center of these accessories.

BRIEF SUMMARY OF THE INVENTION

The invention is an advancement and improvement to the current footwear and footwear accessory technology to improve the player's foot strike on a ball, to enhance the accuracy and power of the strike, to help protect the player from stress injuries to muscles and joints, to protect the player from physical contact injuries to train inexperienced player where to properly contact the ball on their foot, and to enhance the players' confidence in and enjoyment of more consistently making their best and most powerful strikes on a ball during competition and practice.

To help understand how the aforementioned improvements are accomplished by the present invention references are made to two applicable articles; *Relationship between Ball Kick Velocity and Leg Strength: A comparison between soccer players and other athletes*; Noguchi, Demura, and Nagasawa, Advances in Physical Education 2012, Vol. 2, No 3, 95-98, Published online August 2012 in SciRes (http://dx.doi.org/10.4236/ape.2012.23017), and an article on *Biomechanics of Soccer: The soccer-style kick—a slow motion commentary on one of the most common sporting actions in the world*, references cited, (http://www.sportsinjurybulletin.com/archive/biomechanics-soccer.htm#).

In the Noguchi article several points are made relevant to the present invention; (a) when a ball needs to be kicked very hard the instep kick is preferred; (b) it is necessary to kick the ball with the ankle joint in a fixed state so that the force transmitted from the ankle joint to the ball is not dispersed at the moment of impact; (c) superior leg strength will not improve ball kick velocity unless the instep kick technique is mastered.

In the Biomechanics article several points are also relevant to the present invention; (a) a successful kick is defined in terms of velocity and accuracy, and (b) the six components of the kick are; the approach, the foot plant, the back swing of the leg and hip, the hip flexion and knee extension, foot contact, and follow-through. Relevant to the present invention are the four components of the back swing of the hip and leg, the hip flexion and knee extension, foot contact, and follow through. First, the back swing component stores the elastic energy to be released during the next component, the hip flexion and knee extension. In the hip flexion and knee extension component the hip flexors initiate the rapid forward movement of the thigh and as the forward movement of the thigh slows the powerful knee extensors, the quadriceps muscles, begin to accelerate the lower leg and foot. As the knee passes over the ball the lower leg is forcefully extended for the foot contact component. In the foot contact component the foot is forcefully plantarflexed to ideally achieve contact on the ball with the instep of the foot which is closest to the ankle joint and where there is less "give" and less dissipation of energy. Striking lower on the foot towards the toes induces dorisiflexion of the foot which dissipates the strike energy and also puts greater strain on the ankle joint and foot muscles and may dispose kickers to posterior ankle impingement injuries.

The next component of the kick is the beginning of the follow through to slow the hip and leg extensions down. In this phase the Biomechanics article notes a phenomenon known as the "Soccer Paradox". The Soccer Paradox occurs when both the hip and knee extensors and the quadriceps muscles are maximally active extending the leg, the knee, and the foot to contact with the ball but the hamstrings are also at the same moment triggered to slow the hip and leg down on the follow through phase, i.e. the involuntary and necessary braking action of the hamstrings to control the follow through to prevent joint and muscle injuries but which also is a force which significantly counter acts most of the hip and leg energy intended to be used on the ball strike. The Biomechanics article states that only 15% of the kinetic energy of the entire thigh and lower leg swing is transmitted to the ball and the rest of the generated kinetic energy is dissipated by the triggered hamstring muscles.

The Biomechanics article also notes that, as in all ballistic movements, a longer contact time with the ball will maximize the transfer of momentum to the ball and thus increase the ball's trajectory speed.

The present invention preferably has attributes in its design, structure, placement and materials that relate to the points of these articles.

The present invention designed to be located on the instep of the wearer's foot next to the ankle joint at the point where the ball should be ideally struck for maximum energy transfer to the ball.

The present invention has a base and a raised striker section above the base. The main purposes of the raised section are to artificially raise the instep contact point with the ball and to have the foot contact with the ball occur earlier in the hip/leg/foot swing. This earlier contact with the ball in the swing arc is also earlier in the engagement of the hamstring muscles attempting to slow the swing, this results in a force multiplier effect, the quadriceps are still at maximum activity and are not being hampered as early or strongly by the hamstring activity when the ball is struck. This reduction in the Soccer Paradox effect may result in higher ball exit velocity and substantiates test feedback that kickers noticed an "increase in power" when using the present invention.

Because the raised surface is placed over the instep the insert predisposes that the foot strike will occur on the instep near the ankle joint and not lower on the foot towards the toes.

The raised surface also presents an expanded instep surface area for contacting the ball which improves the strike contact area of the foot on the ball and increases the kicker's confidence of a good strike and increased accuracy.

In confluence with the raised and expanded surface area the flexible nature of the insert allows the foot to remain in contact with the ball for a longer period of time because the contact time is extended as the present invention first touches the ball and then collapses onto the firm surface of the kicker's instep. No strike power is lost in the rapid collapse of the raised surface. As stated in the referenced articles ball exit velocity can increase the longer the foot remains in contact with the ball.

The present invention's material construction allows the insert to naturally and quickly resume its original shape after each kick, no outside input or energy is needed to reset the invention.

It is advanced from the summary above that the present invention can improve the player's foot strike on a ball, enhance the accuracy and power of the strike, help protect the player from stress injuries to muscles and joints, protect the player from physical contact injuries, and enhance the players' confidence in and enjoyment of more consistently making their best and most powerful strikes on a ball during competition and practice.

Featured is a sport shoe insert or tongue member comprising a base section conforming to the instep of a foot and a raised striker section upstanding from the base section and deformed when kicking a ball.

In one version, the insert further includes a cylindrical stop member under the raised striker section contacting the instep when the raised striker section is deformed by the ball. The base section and the raised striker section are preferably integral and made of a pliable material of a Shore A durometer between 10 and 90. The raised striker section may be connected to the base section via multiple walls supporting the raised striker section. In one version, one outer wall is curved and another wall is sloping. In another version, the raised striker section is round and is connected to the base section via a circular wall.

The base section may include an aperture beneath the raised striker section and there may be a cavity under the raised striker section. In one embodiment, the base section includes an inward downwardly depending tab.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
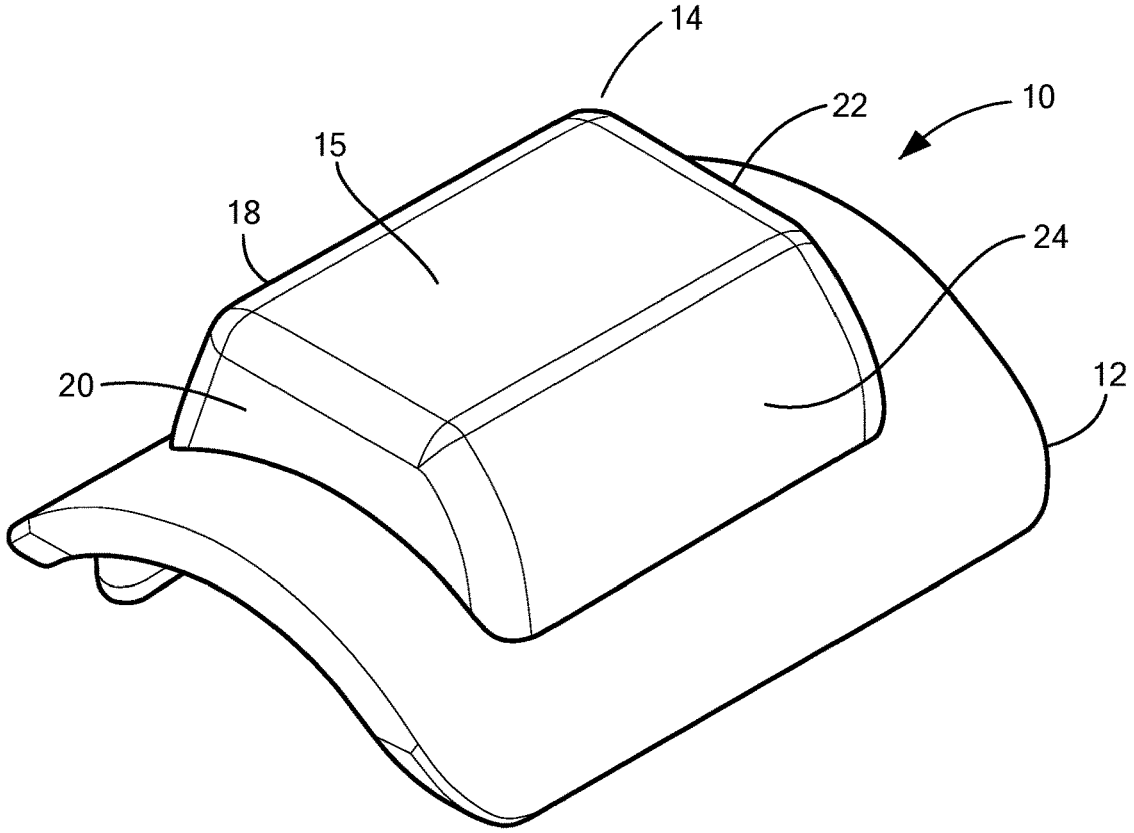
FIG. 1 is a top view of an example of an insert.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
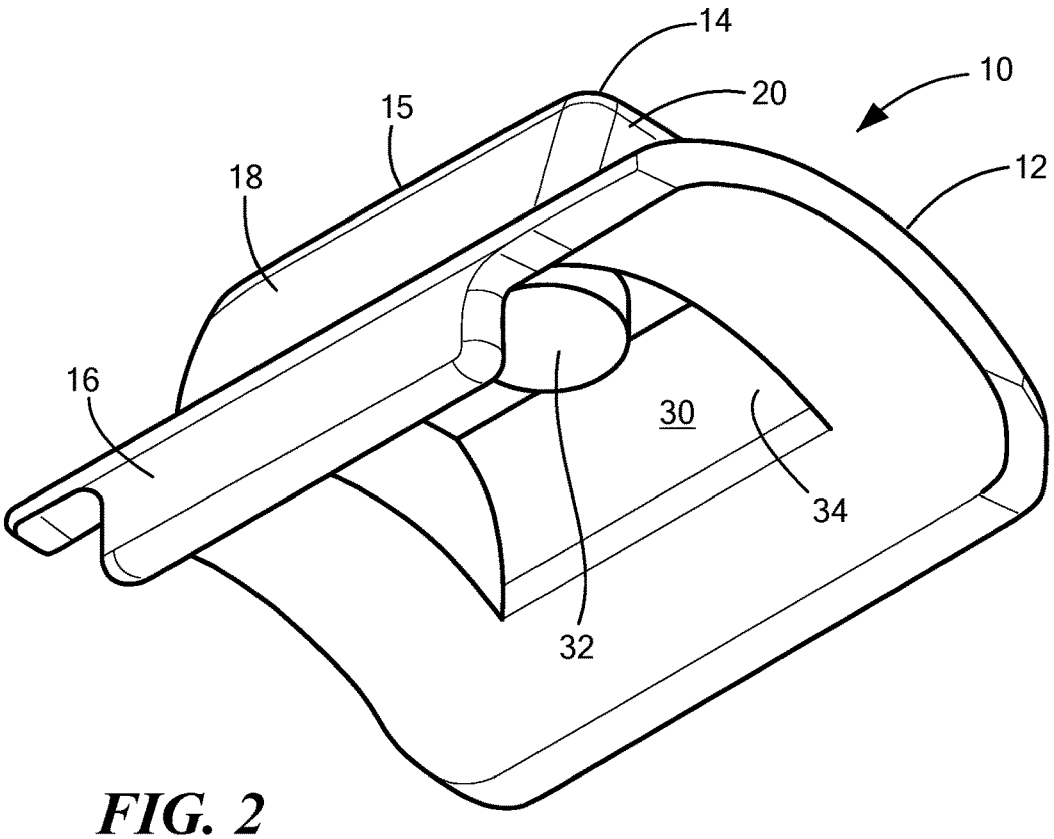
FIG. 2 is a bottom view of the insert of FIG. 1.
Figure 3:
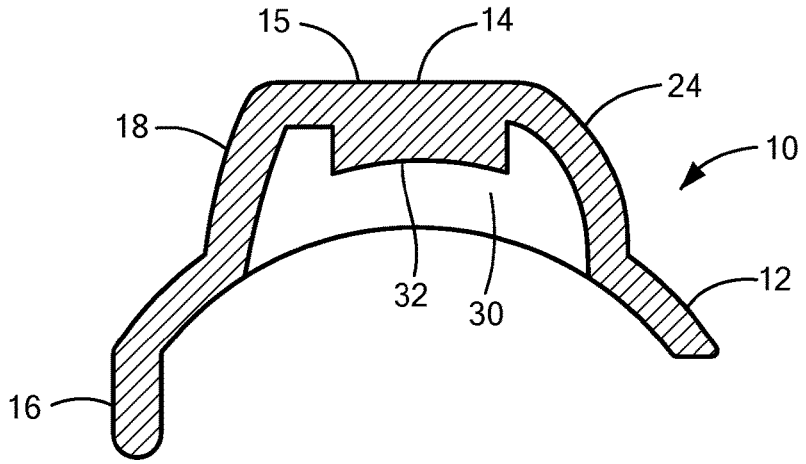
FIG. 3 is a cross-sectional view of the insert of FIGS. 1-2.

In one example, the insert 10, FIGS. 1-3 is constructed of a pliable rubber, vinyl, silicone, or other similar material or compound, a Shore A Durometer between 10 and 90 of such material chosen to allow the invention to deform under varying player kick strengths and to reform to its original shape quickly after the strike. The durometer also chosen to be comfortable to the wearer during sports play and the ball strike and be lightweight.

The insert may be formed as a single molded structure. However, the type of material used for the curved base 12, raised central striker section 14 or the medial and lateral regions may vary. Thus, the material selected for the parts of the article may have a different density/hardness than an article formed from a homogenous single material.

Curved concave base 12, conforming to the instep of the foot, functions primarily to position and hold the insert on top of the wearer's instep and to position raised striker section 14 appropriately for contact with the ball. The base 12 may be 3/16" thick and striker section 14 may rise ½" above the base. Base 12 may be 2.75" long by 2.25" wide. The base may have a radius of curvature of 1.34". The top surface 15 of the striker section 14 may be 1.0" wide by 1¾" long. Inside downwardly depending tab 16 of base 14 functions to better retain the base on the instep and to provide guidance to the wearer regarding the proper orientation of the insert on the foot. Tab 16 may be ¼" long by ¾" wide. Tab 16 placed on the medial side of the foot keeps the insert from shifting on the instep and the reduced area of the tab relative to the length of the base section helps ensure the insert does not contact and interfere with the inside sole of the shoe worn by the wearer. The aforementioned dimension may be varied to fit larger or smaller player's feet.

Raised striker section 14 may have straight vertical sides 18, 20, and 22 and curved outer side 24 to better follow the upper lateral contour of the wearer's shoe or configured on a player's foot for preference in ball strikes.

The raised striker section 14 is preferably hollow as shown in FIGS. 2-3 and thus there is a cavity 30 underneath the top surface 15 of the striker section and a central orifice 34 in base section 12 beneath the raised striker section. The striker section functions to focus the experienced and inexperienced wearer on striking the ball with the instep, to initially cushion the blow and then firm the strike on the instep when striking the ball, to extend the time of contact with the struck ball, and to provide increased surface area for striking the ball enabling better ball control.

The present invention may be worn between the sock and the shoe, between the foot and the sock, may be placed between the tongue of the shoe and the laces of the shoe or may be incorporated into a complete tongue structure of a shoe.

In some embodiments, stop member 32 may be a portion of the underside of top surface 15 extending in the direction towards the aperture 34 in base 12. Varying the distance of the face of stop 32 towards the aperture 34 in base 12 can determine how much flex the insert will exhibit before the flex is concluded when the stop 32 comes in contact with the wearer's instep. Variation of the distance of the stop 32 towards the aperture can be custom designed by the wearer to suit the wearers' personal requirements.

Figure 4:
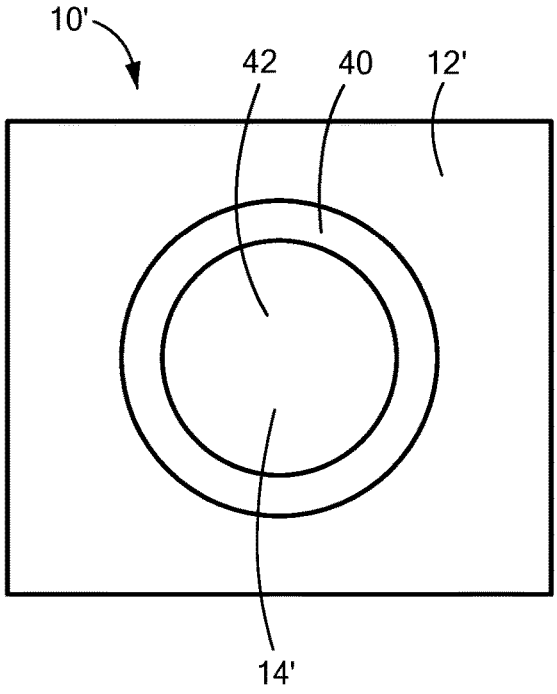
FIG. 4 is a top view of an example of an insert where the raised surface is circular in shape.
Figure 5:
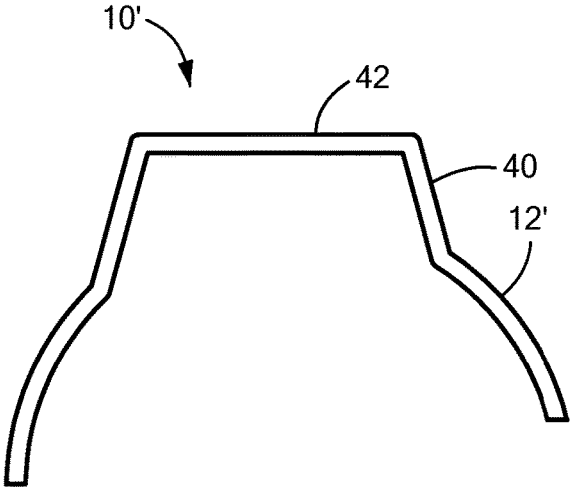
FIG. 5 is cross sectional view of the insert of FIG. 4.

In another embodiment of the invention FIGS. 4-5 show the raised striker section 14' as a circular configuration with circular side wall 40 integral to the base 12' and the top surface 42 connected and integral to the top circumference of circular side wall 40.

Figure 7:
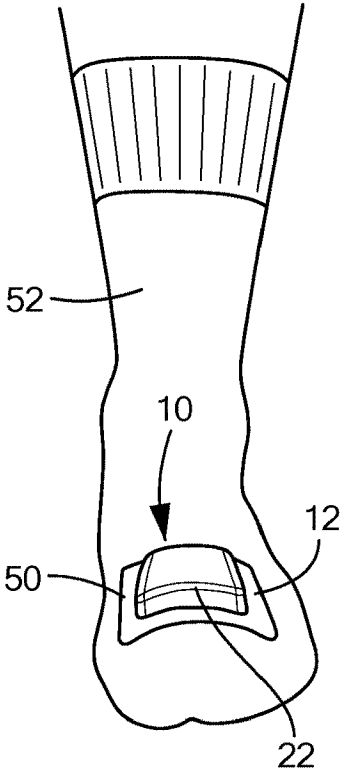
FIG. 7 is a schematic front view of the insert of FIGS. 1-3 on a socked foot.
Figure 6:
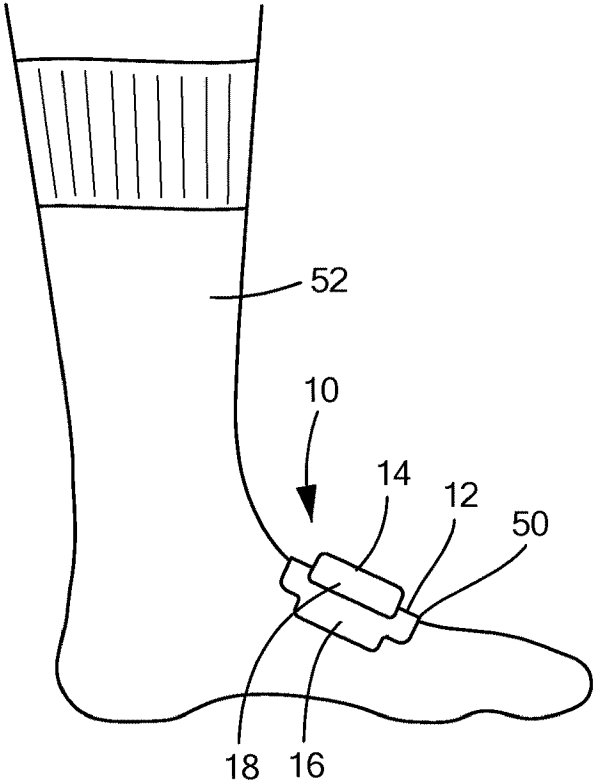
FIG. 6 is a schematic view of the insert of FIGS. 1-3 on a socked foot.

FIGS. 6 and 7 are depictions of the insert 10 in one preferred position resting on the instep 50 of the wearers' socked foot 52.

Figure 8:
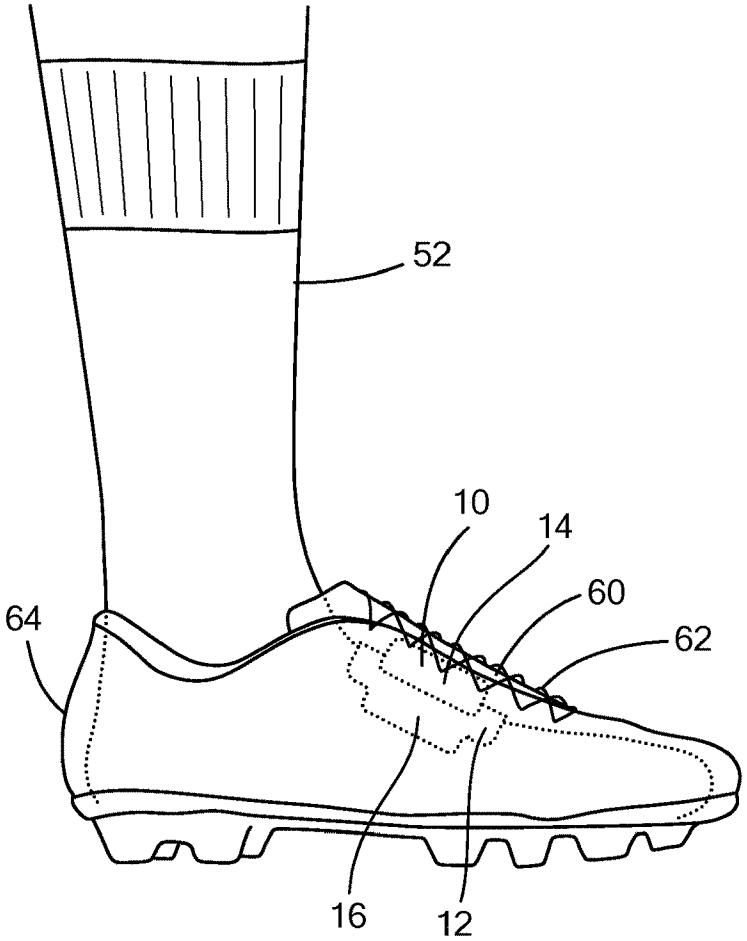
FIG. 8 is a schematic view of a sports footwear with a phantom view of the insert installed under the tongue section of the footwear.

FIG. 8 is a view of insert 10 in the preferred instep position and covered and also partially secured in place by the tongue 60 and shoe laces 62 of the footwear 64.

Figure 9:
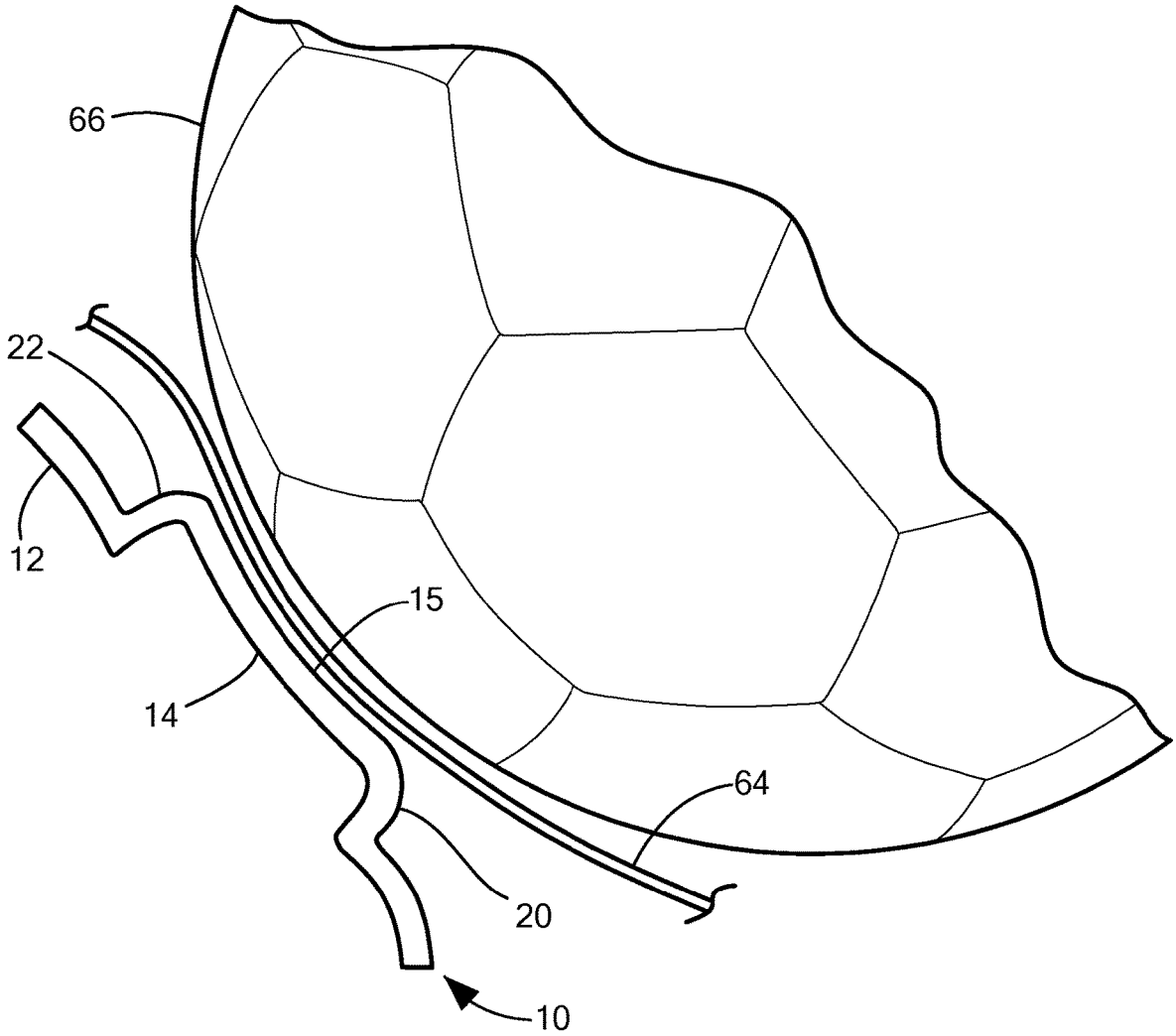
FIG. 9 is a depiction of the insert of the present invention and the footwear surface in the stage of intended deformation upon the strike with a ball.

FIG. 9 is an expanded partial view of a ball surface 66 corning in contact with the surface of the footwear 64 and simultaneously with the raised striker 14 top surface 15. Sides 22, 20 (and 18, 24, FIGS. 1-2) deform as does top surface 15 in a manner that conforms to the surface 66 of the ball and also causing the footwear surface 64 to better conform over an increased area to the ball surface 66. The deformity of the entire insert 10 will cease when the lower surface of top wall 15 contacts the wearers' instep and the ball departs from the wearers' foot. Upon departure of the ball, the insert 10 will due to its material selection and structural design return to its original shape and form ready to repeat its function for the wearer.

Figure 10:
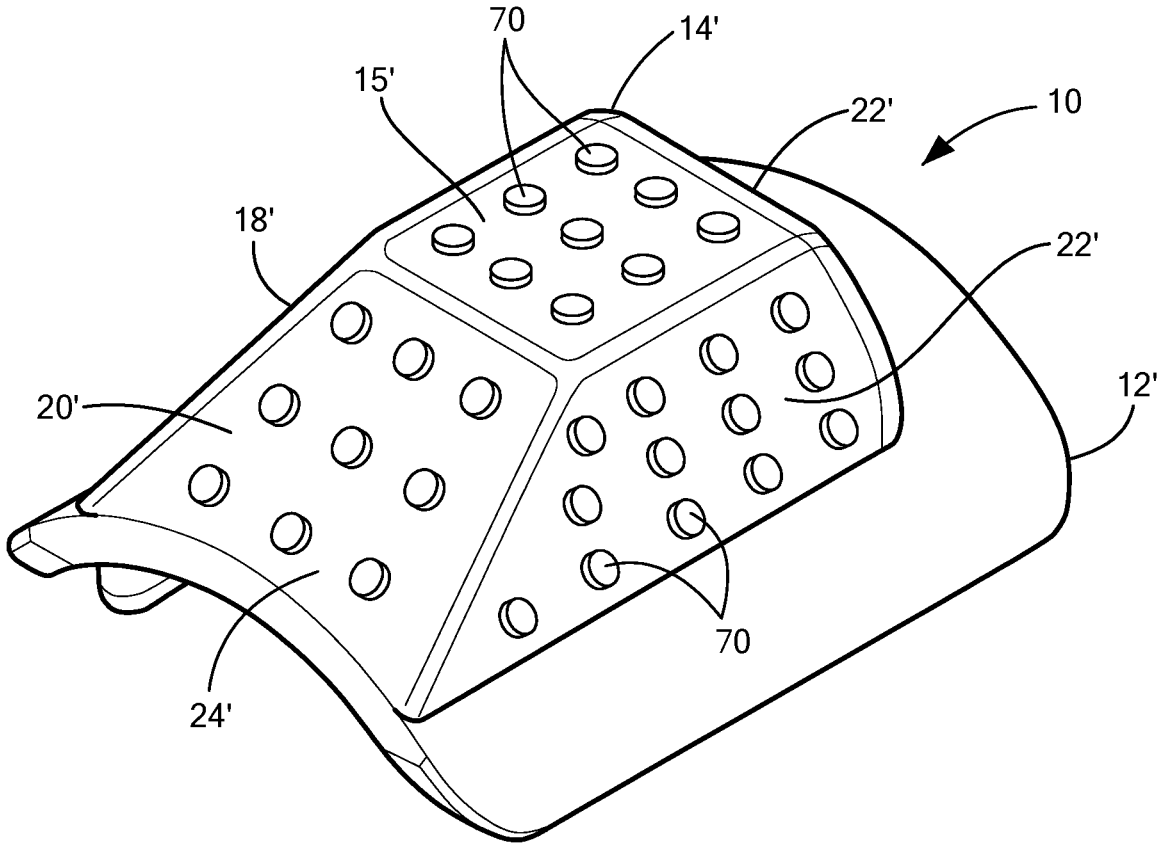
FIG. 10 is a top view of an example of an insert with a slanted support wall and surface friction elements.

In another example of an embodiment of this invention, FIG. 10 depicts the insert as another version of FIGS. 1-5. Curved concave base 12', conforming to the instep of the foot, functions primarily to position and hold the insert on top of the wearer's instep and to position raised striker section 14' appropriately for contact with the ball. The base 12' may be 3/16" thick and striker section 14' may rise ½" above the base. Base 12' may be 3.25" long by 2.25" wide. The base may have a radius of curvature of 1.34". The top surface 15' of the striker section 14' may be 1.0" wide by 1¾" long. Raised striker section 14' may have straight vertical side walls 18', 20', sloping lower side wall 24'; and curved side wall 22'.

Friction elements 70 are upstanding from raised striker section 14', sloping lower side was 24' and curved sidewall 22'.

Friction elements 70 may be included on versions of the present invention and may be formed integrally with and from the same material as the raised striker surface and support walls, may be for varying shapes, designs, and numbers and may have a width of 0.030" and a height above the surfaces of 0.030".

The raised striker section 14' is preferably hollow thus there is a cavity underneath the top surface 15' of the striker section. See also FIGS. 2-3

Figure 11:
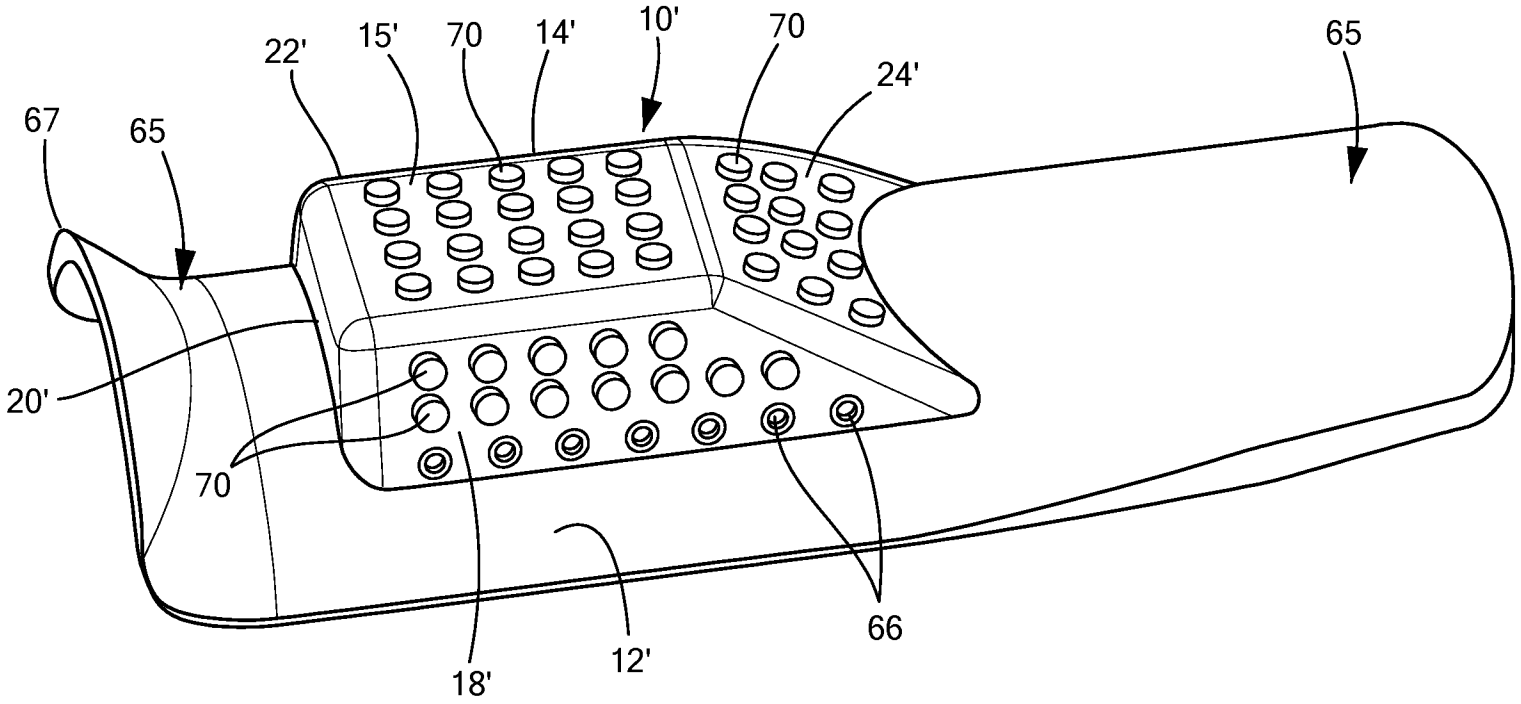
FIG. 11 is a three dimensional view of an insert formed as a shoe tongue unit structure for assembly into a sports shoe.

In another example of an embodiment of this invention, FIG. 11 depicts the present invention 10' as an integral portion of a footwear shoe tongue 65 which can be substituted for a traditional footwear sports shoe tongue. The shoe existing tongues can be removed and insert 10' installed or, at the time of manufacture, the insert 10' can be incorporated into the shoe instead of a traditional tongue. The entire tongue structure may be made from the material of the insert 10' or the insert 10' may be manufactured into a tongue structure of different material.

Curved concave base 12', conforming to the instep of the foot, functions primarily to position the present invention on top of the wearer's instep and to position raised striker section 14' appropriately for contact with the ball. The base 12' may be 3/16" thick and striker section 14' may rise ½" above the base. Base 12' may be 3.25" long by 2.25" wide. Base 12' in this particular embodiment includes elongated section 65 mimicking the traditional shoe tongue. The base may have a radius of curvature of 1.34". The top surface 15' of the striker section 14' may be 1.0" wide by 1¾" long. Raised striker section 14' may have straight vertical side walls 18', 20', sloping lower side wall 24', and curved side wall 22'. Friction elements 70 are depicted on the walls 18', 20', and 24'.

The raised striker section 14' is preferably hollow thus there is a cavity underneath the top surface 15' of the striker section. See also FIGS. 2-3

Optional footwear lace holes 66 are provided through walls 18', 14' into and through which the shoe laces are passed to secure replacement tongue 65 into the shoe and the shoe onto the wearer's foot. Curved raised lip 67 provides a fitting surface against the wearer's ankle joint intersection and a surface for the resting of the shoelace knot off the wearer's foot.

Figure 12:
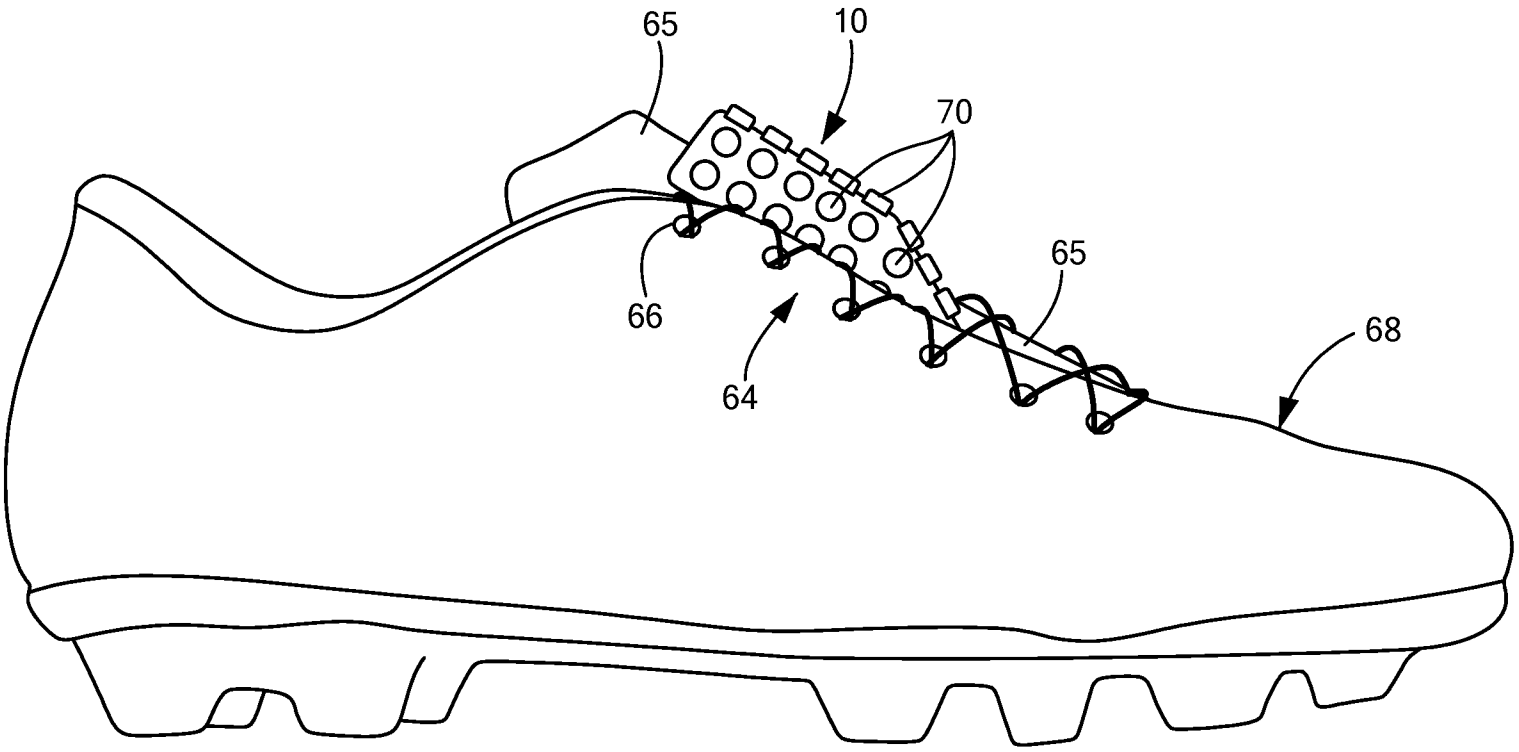
FIG. 12 is a schematic view of a sports footwear with a phantom view of the shoe tongue unit installed into a traditional laced sports footwear.

FIG. 12 is a view of the integrated footwear shoe tongue 65 as installed into a sports footwear and secured with the shoe's laces.

Figure 13:
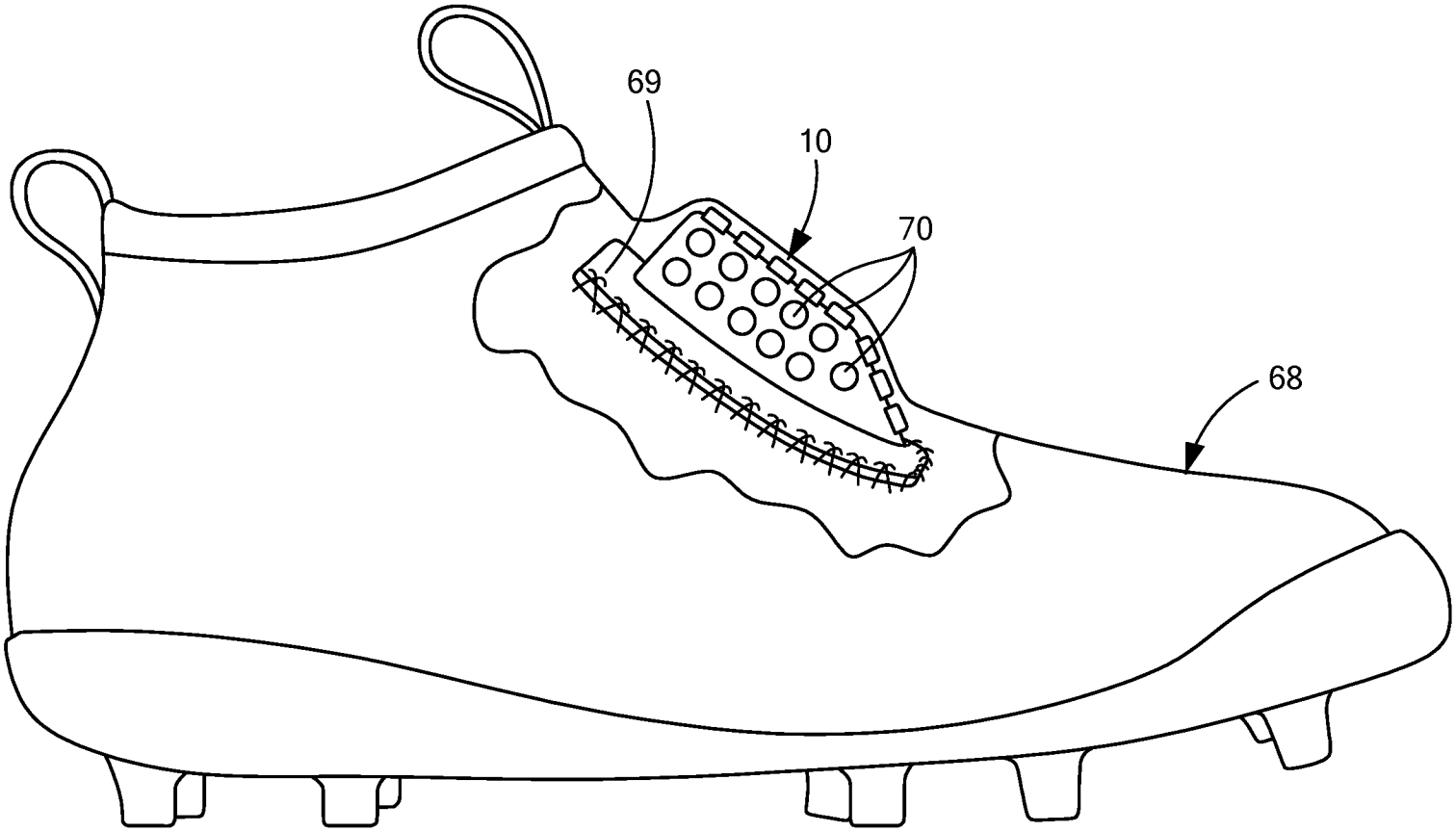
FIG. 13 is a schematic view of a sports footwear with a phantom view of the shoe tongue unit installed into a form fitting sports footwear.

FIG. 13 is a view of footwear 68 that is form fitting footwear and secured to the wearer's foot by strong stretchable elastic materials and not shoe laces. Insert 10 can be secured to the upper instep portion of 68 by adhesives, stitching 69 or alternative means familiar to those skilled in the art of footwear construction. Sports footwear can also incorporate both elastic materials and laces to secure the shoe to the wearer's foot and the manufacturer can choose the attachment of insert 10 or tongue 65 to the upper surface in any manner that allows direct contact between the raised striker 14 top surface 15 and the ball to be struck.

Figure 14:
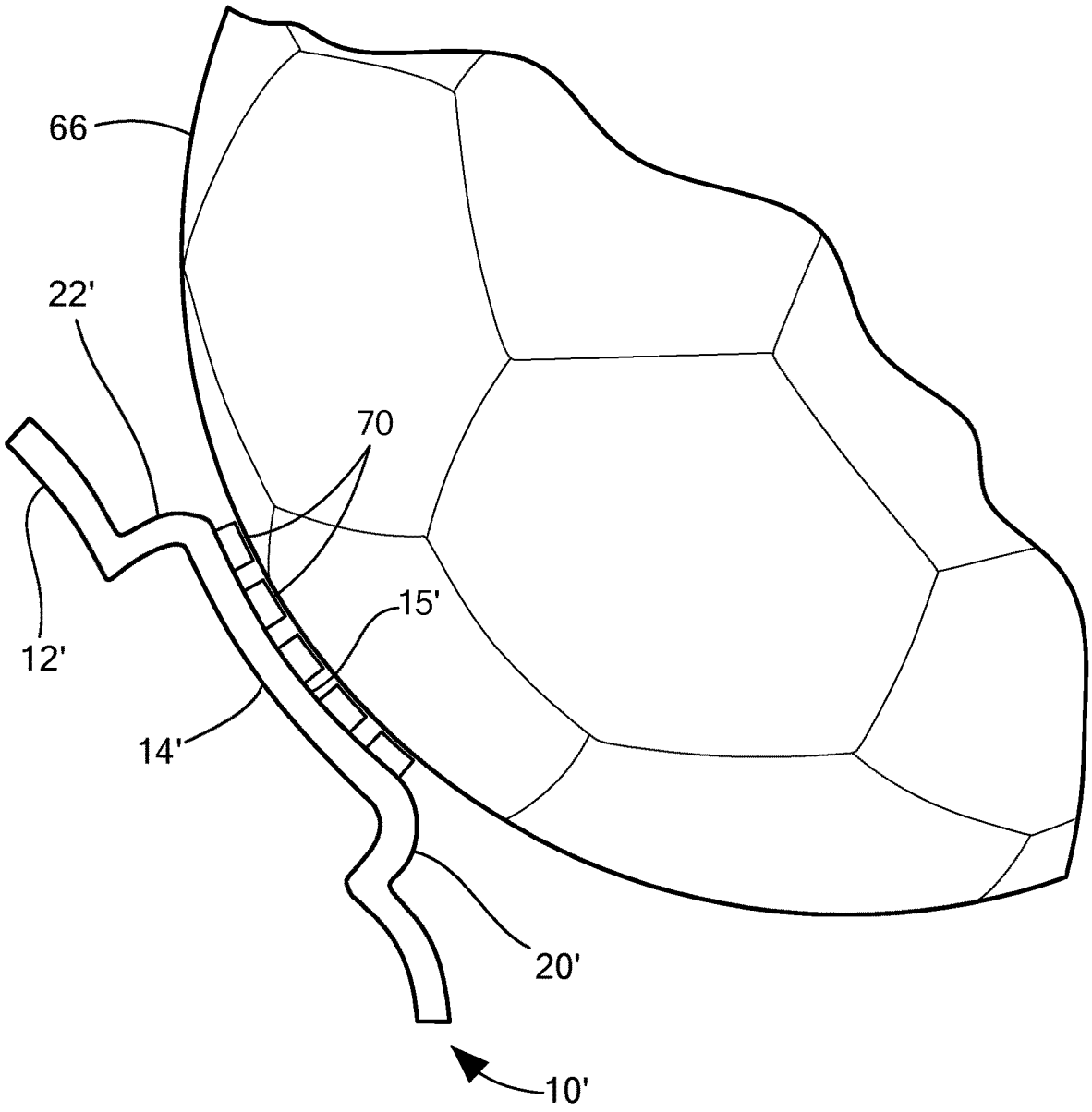
FIG. 14 is a depiction of the insert incorporated into a shoe tongue in the stage of intended deformation of the raised striker surface directly contacting the ball surface.

FIG. 14 is an expanded partial view of a ball surface 66 coming directly in contact with the flexible material of raised striker 14 top surface 15.

The present invention may be installed inside the footwear by a player after removing the existing tongue, may be installed inside the footwear by a footwear manufacturer or aftermarket vendor, or might be installed on the outer side of the footwear by the player, manufacturer, or vendor, or alternatively the base may be internal to the footwear and the raised section external to the footwear.

The present invention is preferably capable of and may also in smaller versions be applied to different parts of the footwear or players foot other than the instep in the manners described above. Obviously in light of the teachings herein many modifications and variations of the invention are possible. It is, therefore to be understood that within the scope of the appended claim, the invention may be practiced otherwise that as specifically described.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A sport shoe tongue comprising:

a base section configured to conform to the instep of a foot, said base section including an aperture therein;

a raised striker section directly upstanding from the base section and above the aperture in the base section, said striker section structured to deform and contact the instep when struck by a ball; and the base section and the raised striker section are integral and made of a pliable material of a Shore A durometer between 10 and 90.

2. The tongue of claim 1, further including a stop member under the raised striker section.

3. The tongue of claim 1 in which the raised striker section is connected to the base section via multiple walls supporting a top wall.

4. The tongue of claim 1 in which a lower wall is sloped.

5. The tongue of claim 3 in which a side wall is curved.

6. The tongue of claim 1 in which the stop member is cylindrical.

7. The tongue of claim 1 in which there is a cavity under the raised striker section.

8. The tongue of claim 1 further including friction elements.

9. The tongue of claim 8 in which the friction elements are installed on the raised striker section.

10. A sport shoe tongue comprising:

a base section configured to conform to the instep of a foot;

a raised striker section upstanding from the base section and structured to deform when struck by a ball; and a cylindrical stop member under the raised striker section.

11. The tongue of claim 10 further including friction elements.

12. The tongue of claim 11 in which the friction elements are installed on the raised striker section.

13. A sport shoe tongue comprising:

a base section configured to conforming to the instep of a foot, said base section including an aperture therein;

a raised striker section directly upstanding from the base section and above the aperture in the base section, said striker section structured to deform and contact the instep when struck by a ball; and a cylindrical stop member under the raised striker section.

14. The tongue of claim 13 further including friction elements.

15. The tongue of claim 14 in which the friction elements are installed on the raised striker section.

* * * * *